US011164495B1

(12) United States Patent
Stinson

(10) Patent No.: US 11,164,495 B1
(45) Date of Patent: Nov. 2, 2021

(54) FIELD-PROGRAMMABLE MOUNTED DISPLAY APPARATUS

(71) Applicant: Ronnie Devon Stinson, San Leandro, CA (US)

(72) Inventor: Ronnie Devon Stinson, San Leandro, CA (US)

( * ) Notice: Subject to any disclaimer, the term of this patent is extended or adjusted under 35 U.S.C. 154(b) by 0 days.

(21) Appl. No.: 17/073,645

(22) Filed: Oct. 19, 2020

Related U.S. Application Data

(63) Continuation-in-part of application No. 16/873,859, filed on Jul. 31, 2020, now abandoned.

(51) Int. Cl.
*G09G 3/04* (2006.01)

(52) U.S. Cl.
CPC ..... *G09G 3/04* (2013.01); *G09G 2330/02* (2013.01); *G09G 2354/00* (2013.01); *G09G 2380/02* (2013.01); *G09G 2380/10* (2013.01)

(58) Field of Classification Search
CPC .. G09G 3/04; G09G 2330/02; G09G 2354/00; G09G 2380/02; G09G 2380/10; G09F 21/04; G06F 3/0482; G06F 1/1652; G06K 9/00228; G06Q 10/02; G06Q 10/025; G06Q 50/30; B60Q 1/2615; G05D 1/0088; G05D 1/0223; H04L 67/18; H04W 4/40; G08G 1/202
See application file for complete search history.

(56) References Cited

U.S. PATENT DOCUMENTS

| | | | | |
|---|---|---|---|---|
| 6,195,000 | B1 * | 2/2001 | Smith | B60Q 1/503 340/425.5 |
| 10,272,827 | B1 * | 4/2019 | Kemler | G05D 1/0223 |
| 2004/0239493 | A1 * | 12/2004 | Miller | G09F 21/04 340/471 |
| 2013/0093660 | A1 * | 4/2013 | Hirsch | G06F 1/1652 345/156 |
| 2014/0039784 | A1 * | 2/2014 | Millspaugh | G08G 1/202 701/300 |
| 2017/0178269 | A1 * | 6/2017 | McKinnon | G06Q 50/30 |
| 2017/0294130 | A1 * | 10/2017 | Donnelly | H04W 4/40 |
| 2018/0074682 | A1 * | 3/2018 | Chen | G06F 3/0482 |
| 2018/0096445 | A1 * | 4/2018 | Eyler | G06Q 10/02 |
| 2018/0190110 | A1 * | 7/2018 | Demisse | G06Q 10/02 |
| 2018/0373936 | A1 * | 12/2018 | Kim | G06K 9/00228 |
| 2019/0232860 | A1 * | 8/2019 | Ferrone | B60Q 1/2615 |
| 2020/0258344 | A1 * | 8/2020 | Brinig | G05D 1/0088 |
| 2020/0300646 | A1 * | 9/2020 | Wang | H04L 67/18 |
| 2021/0192667 | A1 * | 6/2021 | Wang | G06Q 10/025 |

* cited by examiner

*Primary Examiner* — Richard J Hong
(74) *Attorney, Agent, or Firm* — Ashok Tankha

(57) ABSTRACT

A field-programmable data display panel (FPDDP) and a method for displaying media in accordance with the preference of a user on the FPDDP are provided. The FPDDP comprises display elements configured to display alphabets in one of multiple languages and numbers based on programming of the FPDDP via an input module that receives program data and media from a user device. The FPDDP further comprises a rechargeable power supply and a controller that displays the media according to the preferences of the user incorporated in the program data received by the input module. The FPDDP further comprises an adherent backing that allows affixing of the FPDDP to a surface such as the windshield of a car, a foldable display, etc. The rechargeable power supply is capable of being charged from a cigarette lighter socket in a car.

12 Claims, 6 Drawing Sheets

FIELD-PROGRAMMABLE MOUNTED DISPLAY APPARATUS

CROSS-REFERENCE TO RELATED APPLICATIONS

This application is a continuation-in-part application of the non-provisional patent application Ser. No. 16/873,859 titled "Flashpoint", filed in the United States Patent and Trademark Office on Jul. 31, 2020. The specification of the above referenced patent application is incorporated herein by reference in its entirety.

BACKGROUND

Communication has been essential ever since more than one living being inhabited the earth. In today's world, where the world is truly a global village with innumerable people traversing various locations at any given time, proper communication with other persons is very essential. For communication between two persons, where one person is unknown to the other person, display of the name of the person to be contacted on a bright display panel facilitates such communication. In such cases, the display panel needs to be programmable on the fly with a message that can be transmitted from a ubiquitous user device such as a smartphone and which is viewable by the person to be contacted. While smartphone screens may be used to display messages, smart phone screens are generally not big enough to display the name of the person to be contacted that is viewable by the person to be contacted from a distance of more than a few feet from the smart screen. Also, where the smartphone is being used for other purposes, or is not capable of being used for the display for security purposes, or when as when the smartphone display is to be left unattended at a location for more than a certain period of time, a separate programmable display is required. Therefore, there is a need for a display, panel that can be programmed on the fly from a user's smartphone to display messages in text and numerals that is viewable at a distance by the person to be contacted.

As used herein, a user is a person who identifies and picks up a person unknown to the user from a public location, for example a stadium, a terminal for example an airport terminal, a bus terminal, etc., and thereafter transports the person picked up to the destination of choice of the person picked up in the user's car. An example of a user is a taxi driver. There are also instances when identifying hitherto unknown persons is essential for communicating with the unknown person in scenarios ranging from business to personal ones. In most cases, where a person is picked up by a user to be transported to another location, as the person to be picked up is unknown to the user, the user will not recognize the person to be picked up. In such cases, a common practice is for the user to display a placard with the name of the person to be picked up at a location where the user anticipates the person to be picked up will arrive or traverse. The method and system disclosed herein increases the convenience of contacting and picking up a person unknown to the user, and reduces crowding at public locations where a person has to be picked up from. This is especially desirable in view of the social distancing required due to a pandemic such as Covid-19.

The method and system disclosed herein obviates the need for a user, for example, a taxi driver, that drives to pick up a person unknown to the user, from a public location such as an airport, to step out of the vehicle the user is driving. While physical paper, placards, etc., with the name or phone number of the person to be picked up are currently used by a user to attract the attention of the person to be picked up, the placard display method of communication requires human involvement or interfacing between the user and the person to be picked up. The system and method disclosed herein using a smart electronic system that displays information programmed by the user to the person to be picked up by a user, for example a taxi driver, allows the person to be picked up to readily identify the user in the taxi that has been dispatched to pick him up. Self-driven cars would also benefit from such a system.

There is a need for communicating to a user who is picking up a person unknown to the user, and to the person to be picked up, information such as the name of the person to be picked up, displayed by the user at an appropriate location from where the person is to be picked up, to allow the user and the person to be picked up to identify and contact each other at a public location such as an airport terminal. There is also a need for communication that avoids the need for the physical presence of, or physical communication between the user, for example a taxi driver, and the person to be picked up.

Hence, there is a long felt but unresolved need for a field-programmable display panel that displays media on the fly to allow a user, for example a taxi driver, to communicate with and contact a person to be picked up at a public location.

SUMMARY OF THE INVENTION

This summary is provided to introduce a selection of concepts in a simplified form that are further disclosed in the detailed description of the invention and is not intended to determine the scope of the claimed subject matter.

The display panel and the method disclosed herein address the above-mentioned need for a display panel that is programmable on the fly by a user from a user device to display messages comprising words and numbers to a person to be picked up. The display panel and the method disclosed herein address the need for communicating by a user to the person to be picked up, identifiable information such as a name of the person or a phone number of the person to be picked up on the display panel, to capture the attention of the person to be picked up, without the need for the physical presence of the user with the person to be picked up, or any physical communication between the user and the person to be picked up. The display panel and the method disclosed herein address the need for displaying media to the person to be picked up, according to preferences of a user.

The field-programmable data display panel (FPDDP) and the method disclosed herein display media according to preferences of a user on the FPDDP. The FPDDP comprises display elements configured to display alphabets in one of multiple languages and numbers based on programming of the FPDDP. In an embodiment, the FPDDP is flexible and can be disposed on a windshield of a car, or onto a foldable display. The FPDDP further comprises an input module to receive program data and media from a user device through a wired or a wireless connection. The FPDDP further comprises a rechargeable power supply that can be charged from a cigarette lighter socket in a car. The FPDDP further comprises a controller operably connected to the input module and the power supply. The FPDDP also comprises an adherent backing for adhering the FPDDP to surfaces such as a windshield of a car, or a foldable display. The preferences of the user is part of the program data and comprises a choice of a static or a scrolling display, duration of display of each of multiple segments of the media, order of display of the multiple segments of the media, automatic powering off of the FPDDP after a predetermined time of the display of the media, and control of segments of display elements in the FPDDP.

In the method disclosed herein, a user inputs preferences and media to be displayed on the field-programmable data display panel (FPDDP) in a software application on a user device. The user connects the user device to the input module in the FPDDP through a wired or a wireless connection. The software application on the user device programs the controller connected to the input module in the FPDDP through the wired or the wireless connection with program data. The program data comprises software instructions, the preferences of the user and the media to be displayed that is input by the user in the software application. After the programming, the controller in the FPDDP displays the media on the FPDDP in accordance with the preferences of the user, incorporated in the program data received by the input module.

In one or more embodiments, related systems comprise circuitry and/or programming for effecting the methods disclosed herein; the circuitry and/or programming can be any combination of hardware, software, and/or firmware configured to effect the methods disclosed herein depending upon the design choices of a system designer. Also, various structural elements can be employed depending on the design choices of the system designer.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein. The description of a method step or a component referenced by a numeral in a drawing is applicable to the description of that method step or component shown by that same numeral in any subsequent drawing herein.

DETAILED DESCRIPTION OF THE INVENTION

Figure 1:
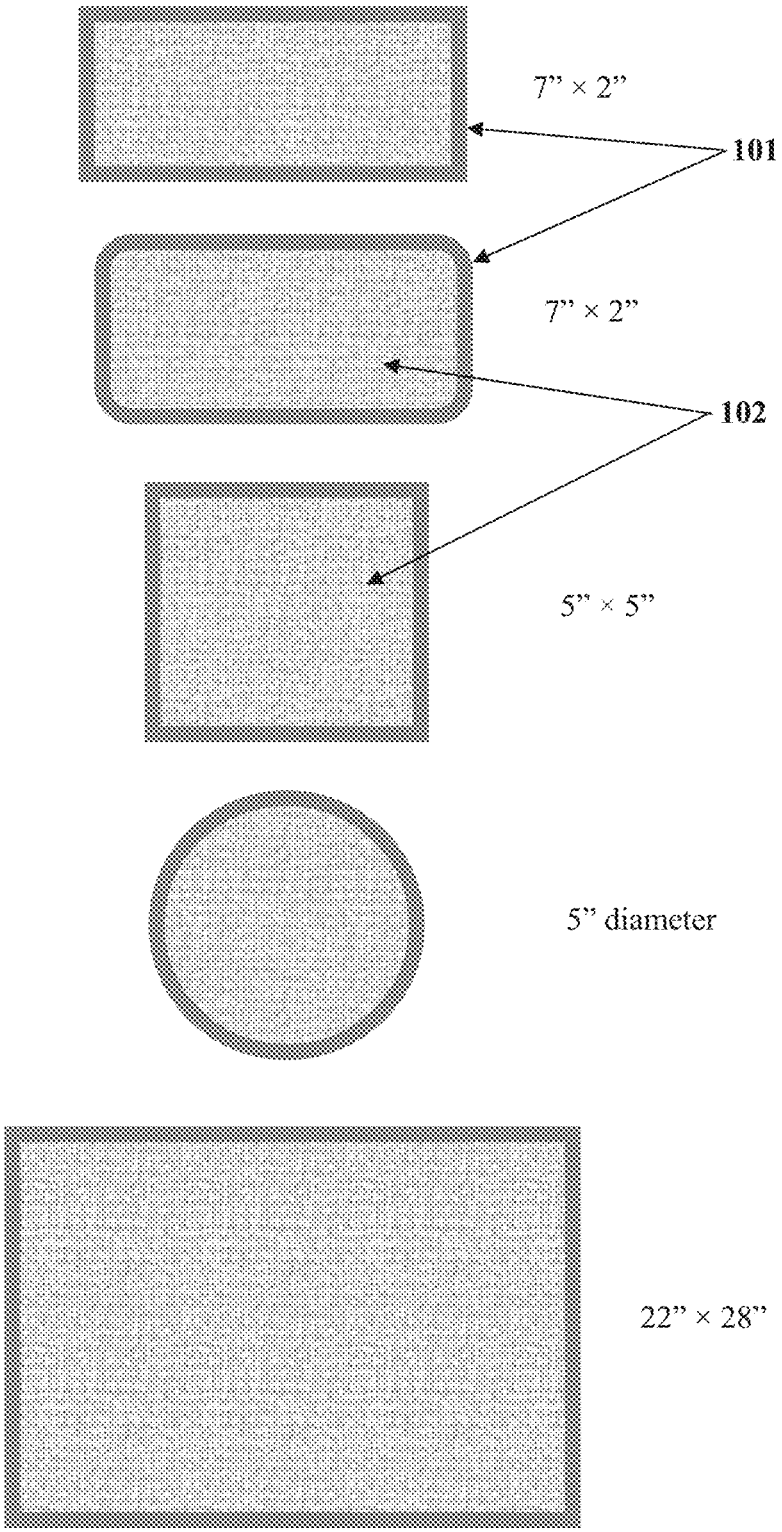
FIG. 1 illustrates a front face of a field-programmable data display panel in a selection of sizes and shapes.

Disclosed herein is a field-programmable data display panel (FPDDP) and a method for displaying media on the display panel in accordance with the preferences of a user. The FPDDP finds uses for displaying names and scores. In an embodiment, the FPDDP is adhered to a windshield of a car and used, for example, to prominently display the name of the person to be picked up by a taxi at an airport. For every pick-up, the FPDDP is programmed from a user device via a software application on the user device. The user device is an electronic device, for example, a personal computer, a portable computing device, a laptop, a touch centric device, a workstation, a server, a client device, a portable electronic device, a network enabled computing device, an interactive network enabled communication device, any other suitable computing equipment, combinations of multiple pieces of computing equipment, etc. In an embodiment, the user device is a smartphone 401, exemplarily illustrated in FIG. 4.

A user, for example, a taxi driver, inputs a name of the person to be picked up, along with any display criteria preferences, for example, a static display, a scrolling display, a flashing display of the name, etc., to a software application on a smartphone. The user then connects the smartphone to the field-programmable data display panel (FPDDP) via a wired or a wireless connection. The software application programs the FPDDP to display the name of the person to be picked up according to the display, criteria. The FPDDP comprises display elements configured to display alphabets in one of multiple languages and numbers based on the programming of the FPDDP. In an embodiment, the display elements are light emitting diodes. The FPDDP is flexible and can be attached to the windshield of a car, or to a foldable display. In an embodiment, the FPDDP has a backing that is a fabric strip with hooks. The hooks can be adhered to a strip with fasteners that is placed on a windshield of a car or any other surface. In an embodiment, a foldable display with a wide surface at an end is affixed near a windshield of a car. The FPDDP is adhered to a strip with fasteners affixed to the surface of the foldable display. When the purpose of the display on the FPDDP is served, for example, when the person to be picked up identifies the user that has come to pick him or her up, by a particular taxi displaying the name of the person to be picked up, the foldable pole on the user's car can be folded to provide an unobstructed view through the windshield of the car. The FPDDP is usable at any place where a portable programmable display would be of use, as the FPDDP can be programmed on the fly from a user device such as a smartphone.

The field-programmable data display panel (FPDDP) comprises an input module to receive program data and media from a user device through a wired or a wireless connection. In an embodiment, the input module receives the program data wirelessly from a remote location through a wireless network. The FPDDP further comprises a rechargeable power supply that can be charged from a cigarette lighter socket in a car. The FPDDP further comprises a controller operably connected to the input module and the power supply. The controller is a microcontroller or an application specific integrated circuit that comprises processor cores and can be programmed with instructions to carry out specific computations and yield outputs of the computations. In an embodiment, the controller has an on-board memory storage media in the form of flash memory for storing instructions, preferences of a user of the FPDDP and media. The program data received from the user device comprises software instructions for the controller and preferences of the user. The preferences of the user comprise a choice of a static display, a scrolling display or a flashing display, duration of display of each of multiple segments of the media, order of display of the multiple segments of the media, automatic powering off of the FPDDP after a predetermined time of the display of the media, and control of segments of display elements in the FPDDP.

FIG. 1 illustrates a front face of a field-programmable data display panel (FPDDP) in a selection of sizes and shapes. In an embodiment, the FPDDP 101 is a thin layer comprising arranged display elements 102 and circuitry (not shown) placed on a flexible adherent backing (not shown), for example, a fabric strip with hooks. The FPDDP can be produced in a variety of shapes and sizes including sizes suitable for affixing the FPDDP on a surface, for example the windshield of a car.

Figure 2:
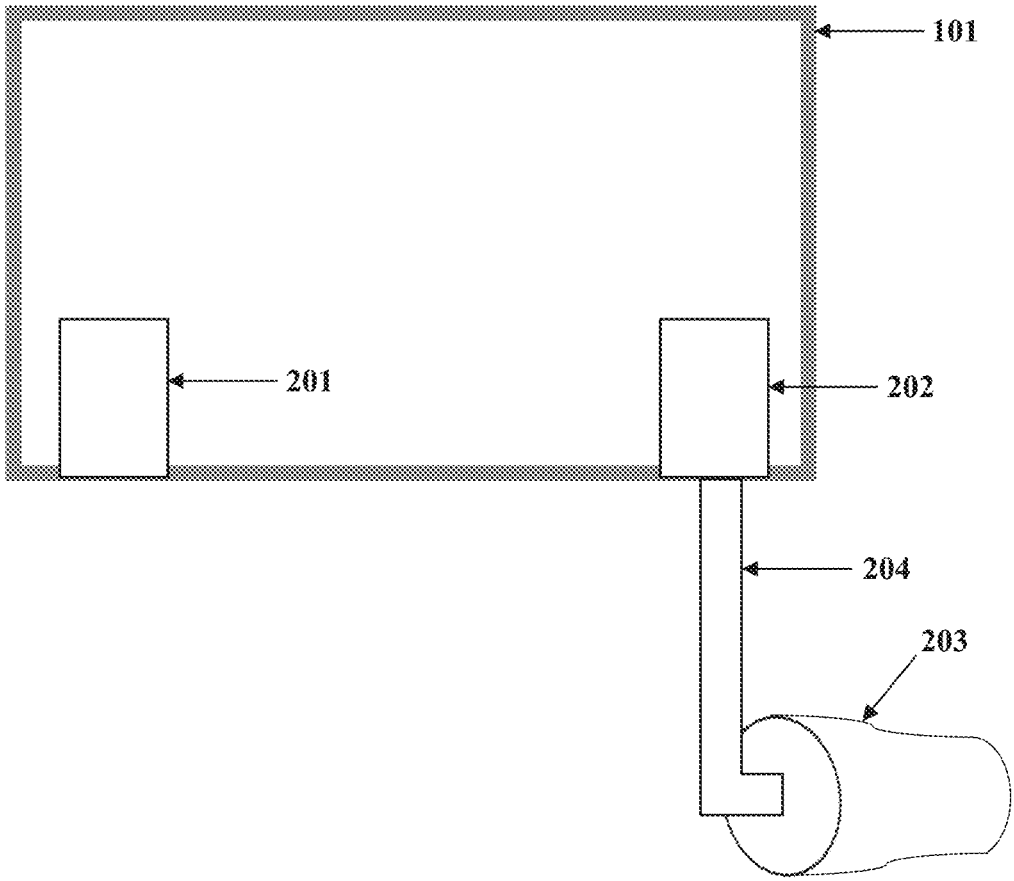
FIG. 2 illustrates a back face of the field-programmable data display panel with an input module port, a power supply charging port, and an adherent backing.

FIG. 2 illustrates a back face of the field-programmable data display panel (FPDDP) 101 with an input module port 201, a power supply charging port 202, and an adherent backing (not shown). On the back of the FPDDP 101, to the left side is an input module port 201 to which a wired connection can be made to a user device 401, exemplarily illustrated in FIG. 4. In an embodiment, a data cable using the USB-C standard that is used with a smartphone is used to connect the input module port 201 to the smartphone. In an embodiment, the input module port 201 also comprises wireless receivers to which a wireless connection, for example, via Bluetooth, can be made from a wireless transmitter on the user device 401. The input module in the FPDDP 101 receives program data and media from a user device 401 through the input port 201. To the right side is a charging port 202 for charging a rechargeable power supply in the FPDDP 101. In an embodiment, the rechargeable power supply can be charged via a charging cable from a cigarette lighter socket 203 in a car using a charging cable 204. In another embodiment, the charging port 202 comprises induction coils for wireless charging of the rechargeable power supply.

Figure 3:
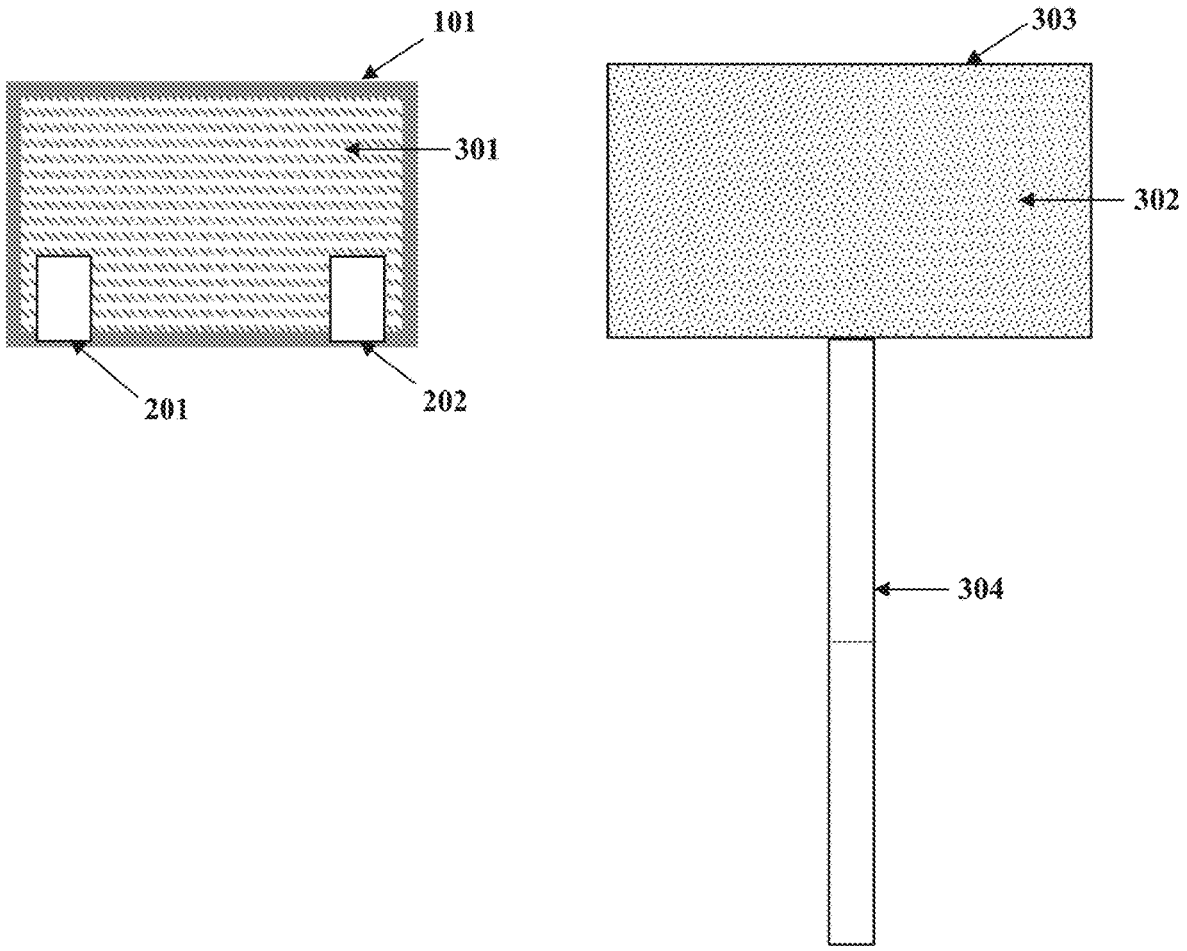
FIG. 3 exemplarily illustrates means of attachment of the field-programmable data display panel to a foldable display using a hook and loop fastener.

FIG. 3 exemplarily illustrates attachment of the field-programmable data display panel (FPDDP) 101 to a foldable pole 304 using a hook and loop fastener. The back of the FPDDP 101 comprises a flexible adherent backing, for example, a fabric strip with hooks 301, that is adhered to a suitable surface, for example, a surface comprising a fabric strip with loops 302. As illustrated, the fabric strip with loops 302 is affixed to a wide surface 303 at one end of a foldable pole 304. The foldable pole 304 is made of plastic or a light metal. When the FPDDP 101 is affixed, for example, to a windshield of a car, the foldable pole 304 can be folded out of the way to provide an unobstructed view through the windshield when the FPDDP 101 is not being used. Due to the removable structure of hook and loop fasteners, the FPDDP 101 can also be detached from the foldable pole 304.

Figure 4:
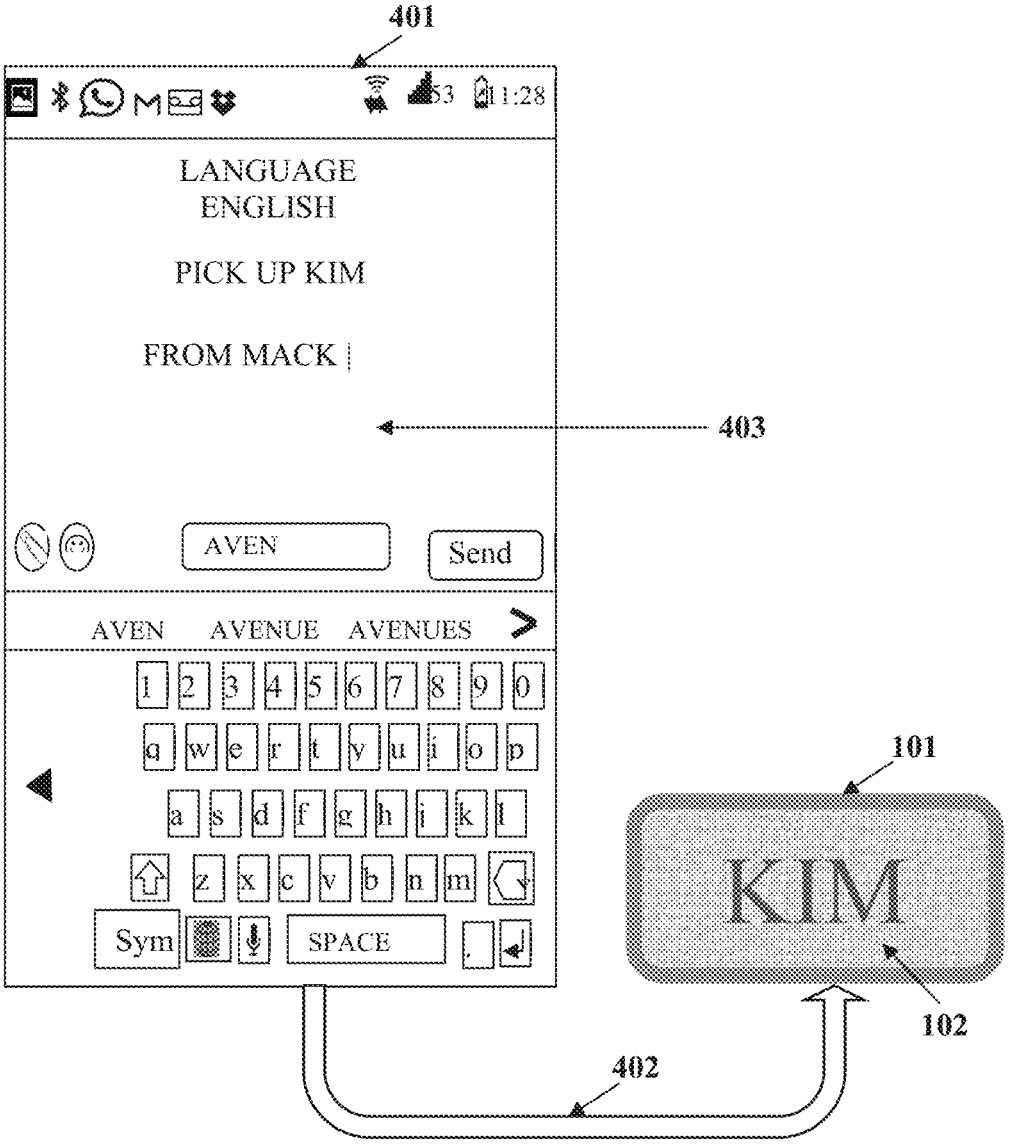
FIG. 4 exemplarily illustrates a wired connection between a user device and the field-programmable data display panel for programming the field-programmable data display panel.

FIG. 4 exemplarily illustrates a wired connection between a user device 401 and the field-programmable data display panel (FPDDP) 101 for programming the FPDDP 101. A smartphone 401 is connected to the input module port on the FPDDP 101 using a data cable 402, as described in the detailed description of FIG. 2. The screen 403 of the user's smartphone displays an exemplary illustration of a software application that is used by a user of the smartphone to input preferences of the user and media to be displayed on the display elements 102 of the FPDDP 101. The user uses the software application to program the controller on the FPDDP 101 with program data comprising software instructions, the preferences of the user, and the media to be displayed on the FPDDP 101.

Figure 5:
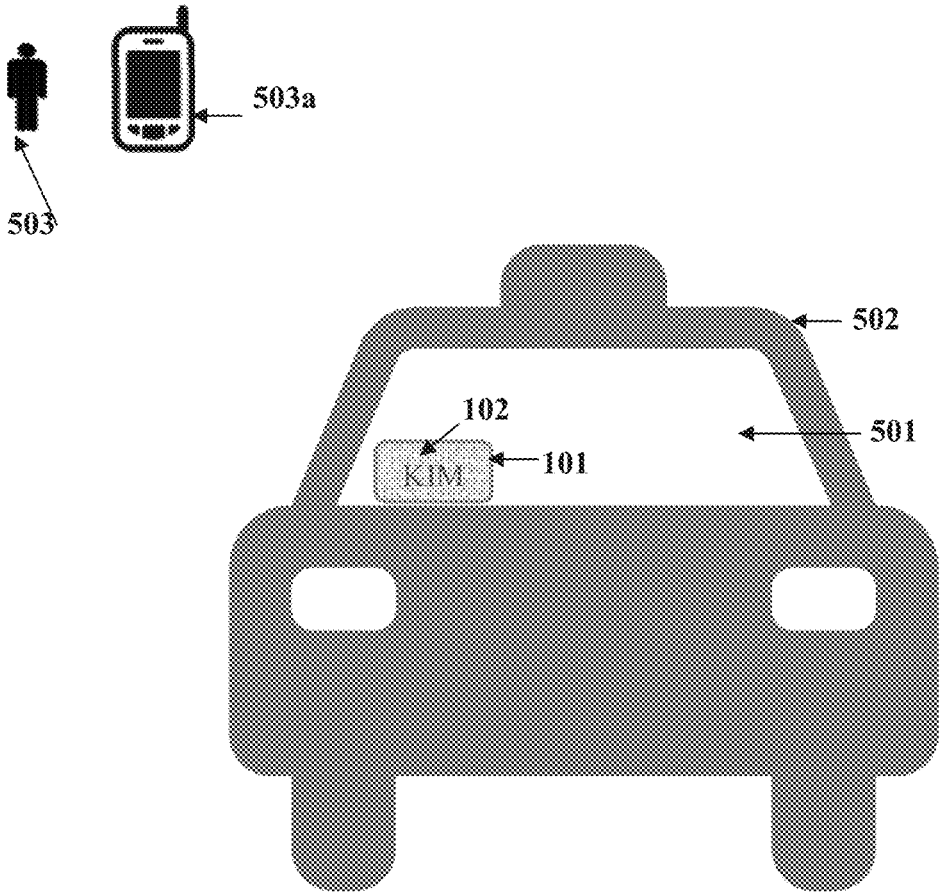
FIG. 5 exemplarily illustrates the field-programmable data display panel adhered to a windshield of a car.

FIG. 5 exemplarily illustrates the field-programmable data display panel (FPDDP) 101 adhered to a windshield 501 of a user's car 502. The FPDDP 101 can be adhered directly to the windshield 501, or adhered to a foldable pole 304 affixed in proximity to the windshield 501 using a fastening mechanism, for example, a hook and loop fastener with hooks affixed to the back face of the FPDDP 101 and loops disposed on the windshield 501 or on a wide surface at one end of the foldable pole 304.

In an embodiment, the person to be picked 503 up sends an electronic message using his or her user device 503*a*, for example, a smartphone back to the user device 401 of the user, for example, a taxi driver. The person to be picked up 503 sends the electronic message when the person to be picked up 503 sees a message on his or her user device 503*a* from the user, for example, the taxi driver. Alternatively, the person to be picked up 503 sends a message to the user without receiving a message from the user. In an embodiment, the messages from both the person to be picked up 503 and the user contain information regarding the location of the user at the public location, for example, the location of the user at an airport.

In an embodiment, the software application on the user device 401 is capable of reading and interpreting one or more keywords in the messages received by the smartphone 401 from the person to be picked up 503. When the user, for example, a taxi driver inputs the name of the person to be picked up 503 into the smartphone along with any display criteria preferences, the user also inputs the phone number of the person to be picked up 503. The software application can therefore identify incoming messages from the person to be picked up 503. When the person to be picked up 503 sees multiple taxis each using FPDDPs 101 in a public location, for example, at an airport, it may be difficult for the person to be picked up 503 to identify the taxi that has come to receive the person to be picked up 503. Therefore, to allow the person to be picked up 503 to quickly identify his or her taxi, the person to be picked up 503 sends a message comprising one or more keywords to the smartphone 401. The software application, upon reading and interpreting the keywords alters the display criteria preferences of the FPDDP. The keywords, for example, comprise "Scroll Left", Scroll Right", Scroll Up", "Scroll Down", "Flash", "Static", and "Speed—Number". In the keyword, "Speed—Number", for example, "Speed—2" or "Speed—3" in combination with another keyword, for example, "Flash" speeds up the flashing of the name of the person to be picked up 503 being displayed by two or three times the normal display speed. The person to be picked up 503 by the user can send a message comprising one or more keywords and the software application reads and interprets the one or more keywords in the messages received by the smartphone 401 of the user and alters the display criteria preferences of the FPDDP to display the name of the name or other identification of the person to be picked up 503, in accordance with the keywords entered in the FPDDP.

Figure 6:
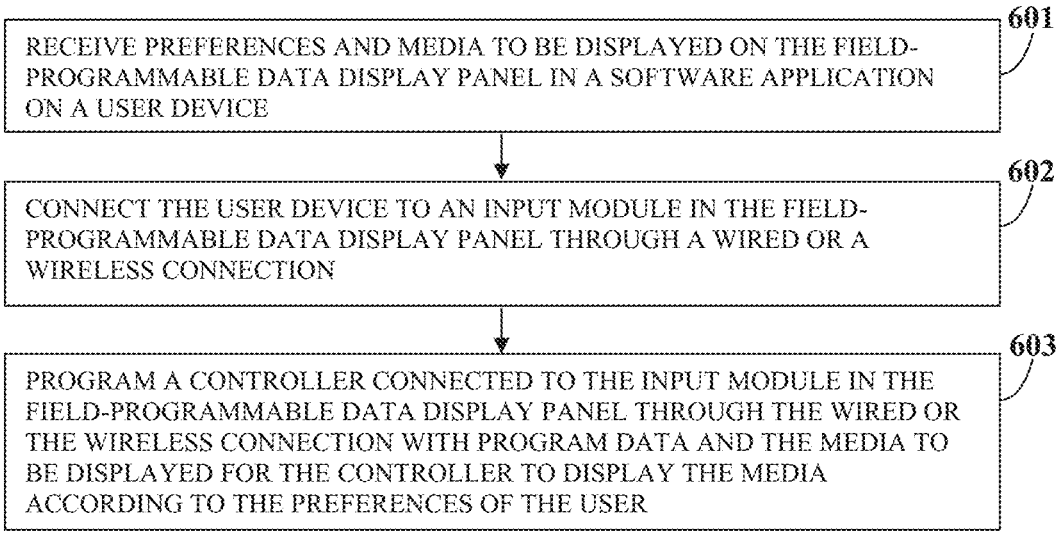
FIG. 6 illustrates a method for displaying media according to preferences of a user on the field-programmable data display panel.

FIG. 6 illustrates a method for displaying media according to preferences of a user on the field-programmable data display panel (FPDDP) 101. A user inputs 601 preferences and media to be displayed on the FPDDP 101 in a software application on a user device 401. The user connects 602 the user device 401 to the input module in the FPDDP 101 through a wired or a wireless connection. The software application on the user device 401 programs 603 the controller connected to the input module in the FPDDP 101 through the wired or the wireless connection with program data and the media to be displayed on the FPDDP 101. The program data comprises software instructions and the preferences of the user that is input by the user in the software application. After the programming, the controller in the FPDDP 101 displays the media in accordance with the preferences of the user incorporated in the program data received by the input module. The preferences of the user comprise a choice of a static display, a scrolling display, or a flashing display, duration of display of each segment of multiple segments of the media, order of display of the segments of the media, automatic powering off of the field-programmable data display panel after a predetermined time of display of the media, and control of segments of display elements in the field-programmable data display panel.

It will be readily apparent in different embodiments that the various methods and computer programs disclosed herein are implemented on computer readable media appropriately programmed for computing devices. As used herein, "computer readable media" refers to non-transitory computer readable media that participate in providing data, for example, instructions that are read by a computer, a processor or a similar device. The "computer-readable media" further refers to a single medium or multiple media, for example, a centralized database, a distributed database, and/or associated caches that store one or more sets of instructions that are read by a computer, a processor or a similar device. The "computer-readable media" further refers to any medium capable of storing or encoding a set of instructions for execution by a computer, a processor or a similar device and that causes a computer, a processor or a similar device to perform any one or more of the methods disclosed herein. Non-transitory computer readable media comprise all computer readable media, for example, non-volatile media, volatile media, and transmission media, except for a transitory, propagating signal. Non-volatile media comprise persistent memory volatile media including a dynamic random access memory (DRAM), which typically constitutes a main memory. Volatile media comprise, for example, a register memory, a processor cache, a random access memory (RAM), etc. Transmission media comprise, for example, coaxial cables, copper wire, fiber optic cables, etc., including wires that constitute a system bus coupled to a processor, etc. Common forms of computer readable media comprise, for example, magnetic tape, any magnetic medium, any optical medium, a flash memory card, a random access memory (RAM), a programmable read only memory (PROM), an erasable programmable read only memory (EPROM), an electrically erasable programmable read only memory (EEPROM), a flash memory, any other memory chip or cartridge, or any other medium from which a computer can read.

In an embodiment, the computer programs that implement the methods and algorithms disclosed herein are stored and transmitted using a variety of media, for example, the computer readable media in a number of manners. In an embodiment, hard-wired circuitry or custom hardware is used in place of, or in combination with, software instructions for implementing the processes of various embodiments. Therefore, the embodiments are not limited to any specific combination of hardware and software. The software instructions comprising computer executable instructions can be implemented in any programming language. Examples of programming languages that can be used comprise C, C++, C#, Java®, JavaScript®, Fortran, Ruby, Perl®, Python®, Visual Basic®, hypertext preprocessor (PHP), Microsoft®.NET, Objective-C® etc. Other object-oriented, functional, scripting, and/or logical programming languages can also be used. In an embodiment, the software programs are stored on or in one or more mediums as object code. The software instructions disclosed herein comprises one or more computer program codes for implementing the processes of various embodiments.

The foregoing examples have been provided merely for the purpose of explanation and are in no way to be construed as limiting of the method and the field-programmable data display panel (FPDDP) 101 disclosed herein. While the method and the FPDDP 101 have been described with reference to various embodiments, it is understood that the words, which have been used herein, are words of description and illustration, rather than words of limitation. Further, although the method and the FPDDP 101 have been described herein with reference to particular means, materials, and embodiments, the method and the FPDDP 101 are not intended to be limited to the particulars disclosed herein; rather, the method and the FPDDP 101 extend to all functionally equivalent structures, methods and uses, such as are within the scope of the appended claims. Those skilled in the art, having the benefit of the teachings of this specification, may effect numerous modifications thereto and changes may be made without departing from the scope and spirit of the method and the FPDDP 101 disclosed herein in their aspects.

I claim:

1. A system for displaying media on a field-programmable data display panel based on program data received from a software application on a mobile device of a taxi driver and changing the media displayed on the field-programmable data display panel based on one or more keywords received from a mobile device of a passenger to be picked up, said system comprising:

said field-programmable data display panel, comprising:

a plurality of display elements configured to display the media comprising one or more of alphabets in one of a plurality of languages programmed in the field-programmable data display panel, and numerals;

an input module configured to receive program data and the media to be displayed from the mobile device of the taxi driver, wherein the taxi driver is a person that identifies and picks up the passenger from a public location, wherein the input module is configured to receive the program data and the media from the software application on the mobile device of the taxi driver through one or more of a wired and a wireless connection, and wherein the program data comprises user preferences and software instructions;

a rechargeable power supply;

a controller operably connected to the input module and the power supply, wherein the controller is configured to display the media on the field-programmable data display panel in accordance with the program data received from the software application on the mobile device of the taxi driver; and an adherent backing configured to adhere the field-programmable data display panel to surfaces;

said software application on the mobile device of the taxi driver configured to receive a phone number of the passenger to be picked up as input from the mobile device of the taxi driver, wherein the received phone number enables the software application on the mobile device of the taxi driver to recognize an incoming text message from the mobile device of the passenger to be picked up;

said software application on the mobile device of the taxi driver configured to identify the incoming text message from the mobile device of the passenger to be picked up to read and interpret the one or more keywords in the incoming text message, wherein the one or more keywords comprise "Scroll Left", Scroll Right", Scroll Up", "Scroll Down", "Flash", "Static", and "Speed—Number";

said software application on the mobile device of the taxi driver configured to program the controller in the field-programmable data display panel based on the one or more keywords;

said controller in the field-programmable data display panel configured to change the media displayed on the field-programmable data display panel in accordance with the one or more keywords in the incoming text message received from the mobile device of the passenger to be picked up.

2. The field-programmable data display panel of claim 1, wherein the field-programmable display panel is flexible.

3. The field-programmable data display panel of claim 1, wherein the field-programmable display panel is configured to be attached to a windshield of a taxi.

4. The field-programmable data display panel of claim 1, wherein the rechargeable power supply is charged from a cigarette lighter socket in a taxi.

5. The field-programmable data display panel of claim 1, wherein the media is displayed based on the user preferences, wherein the media is name or other identification of the passenger to be picked up, wherein the user preferences are part of the program data and comprises a choice of one of a static display, a scrolling display, and a flashing display, and wherein the user preferences further comprise duration of display of each segment of a plurality of segments of the media, order of display of the plurality of segments of the media, automatic powering off of the field-programmable data display panel, and control of segments of display elements in the field-programmable data display panel.

6. A method for displaying media on a field-programmable data display panel based on program data received from a software application on a mobile device of a taxi driver and changing the media displayed on the field-programmable data display panel based on one or more keywords received from a mobile device of a passenger to be picked up, the method comprising:

connecting the mobile device of the taxi driver to the field-programmable data display panel through one of a wired and a wireless connection;

receiving program data and the media to be displayed as input from the mobile device of the taxi driver, by an input module in the field-programmable data display panel, wherein the taxi driver is a person that identifies and picks up the passenger from a public location, wherein the input module is configured to receive the program data and the media from the software application on the mobile device of the taxi driver through the one of the wired and the wireless connection, and wherein the program data comprises user preferences and software instructions;

receiving a phone number of the passenger to be picked up as input from the mobile device of the taxi driver, by the software application on the mobile device of the taxi driver, wherein the received phone number enables the software application on the mobile device of the taxi driver to recognize an incoming text message from the mobile device of the passenger to be picked up;

programming a controller in the field-programmable data display panel by the software application on the mobile device of the taxi driver through the one of the wired and the wireless connection with the program data comprising user preferences and software instructions;

displaying the media on the field-programmable data display panel in accordance with the program data received from the software application on the mobile device of the taxi driver;

receiving a text message from the mobile device of the passenger to be picked up, by the software application on the mobile device of the taxi driver, wherein the incoming text message comprises one or more keywords, and wherein the one or more keywords comprise "Scroll Left", Scroll Right", Scroll Up", "Scroll Down", "Flash", "Static", and "Speed—Number";

identifying the incoming text message received from the mobile device of the passenger to be picked up, by the software application on the mobile device of the taxi driver, to read and interpret the one or more keywords in the incoming text message;

programming the controller in the field-programmable data display panel based on the one or more keywords in the incoming text message received from the mobile device of the passenger to be picked up, by the software application in the mobile device of the taxi driver; and changing the displayed media on the field-programmable data display panel, by the controller in the field-programmable data display panel, in accordance with the one or more keywords in the incoming text message received from the mobile device of the passenger to be picked up.

7. The method of claim 6, wherein the media is displayed based on the user preferences, wherein the media is name or other identification of the passenger to be picked up, wherein the user preferences are part of the program data and comprises a choice of one of a static display, a scrolling display, and a flashing display, and wherein the user preferences further comprise duration of display of each segment of a plurality of segments of the media, order of display of the plurality of segments of the media, automatic powering off of the field-programmable data display panel, and control of segments of display elements in the field-programmable data display panel.

8. The method of claim 6, wherein the field-programmable data display panel comprises an adherent backing for adhering to surfaces.

9. The method of claim 6, wherein the field-programmable data display panel is flexible.

10. The method of claim 6, wherein the field-programmable data display panel is configured to be attached to a windshield of a taxi.

11. The method of claim 6, wherein the rechargeable power supply is charged from a cigarette lighter socket in a taxi.

12. A system for displaying media on a field-programmable data display panel based on program data received from a software application on a mobile device of a taxi driver and changing the media displayed on the field-programmable data display panel based on one or more keywords received from a mobile device of a passenger to be picked up, said system comprising:

said field-programmable data display panel, comprising:

a plurality of display elements configured to display the media comprising one or more of alphabets in one of a plurality of languages programmed in the field-programmable data display panel, and numerals;

an input module configured to receive program data and the media to be displayed from the mobile device of the taxi driver, wherein the taxi driver is a person that identifies and picks up the passenger from a public location, wherein the input module is configured to receive the program data and the media from the software application on the mobile device of the taxi driver through one or more of a wired and a wireless connection, and wherein the program data comprises user preferences and software instructions;

a rechargeable power supply;

a controller operably connected to the input module and the power supply, wherein the controller is configured to display the media on the field-programmable data display panel in accordance with the program data received from the software application on the mobile device of the taxi driver; and said software application on the mobile device of the taxi driver configured to read and interpret the one or more keywords in an incoming text message on the mobile device of the taxi driver, wherein the one or more keywords comprise "Scroll Left", Scroll Right", Scroll Up", "Scroll Down", "Flash", "Static", and "Speed—Number";

said software application on the mobile device of the taxi driver configured to program the controller in the field-programmable data display panel based on the one or more keywords; and said controller in the field-programmable data display panel configured to change the media displayed on the field-programmable data display panel in accordance with the one or more keywords in the incoming text message.

* * * * *